US008980397B2

(12) United States Patent
Patberg et al.

(10) Patent No.: US 8,980,397 B2
(45) Date of Patent: Mar. 17, 2015

(54) STRUCTURED COMPOSITE SHEET

(75) Inventors: Lothar Patberg, Moers (DE); Klaus Blümel, Dinslaken (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 545 days.

(21) Appl. No.: 12/440,660

(22) PCT Filed: Aug. 14, 2007

(86) PCT No.: PCT/EP2007/058414

§ 371 (c)(1),
(2), (4) Date: Jun. 10, 2009

(87) PCT Pub. No.: WO2008/031682

PCT Pub. Date: Mar. 20, 2008

(65) Prior Publication Data

US 2009/0280348 A1 Nov. 12, 2009

(30) Foreign Application Priority Data

Sep. 11, 2006 (DE) ..... 10 2006 043 197

(51) Int. Cl.
*E04C 2/00* (2006.01)
*E04C 2/08* (2006.01)
*E04C 2/32* (2006.01)

(52) U.S. Cl.
CPC .. *E04C 2/324* (2013.01); *E04C 2/08* (2013.01)
USPC ..... 428/72; 428/156; 428/600; 52/419; 52/424

(58) Field of Classification Search
USPC ..... 428/72, 158, 604, 594; 52/419, 425, 52/437, 450, 453, 784.14
See application file for complete search history.

(56) References Cited

U.S. PATENT DOCUMENTS

| | | | | | |
|---|---|---|---|---|---|
| 777,656 | A | | 12/1904 | Banning | |
| 3,086,899 | A | * | 4/1963 | Smith et al. | 428/158 |
| 3,525,417 | A | * | 8/1970 | Giraudeau | 181/208 |
| 4,267,679 | A | * | 5/1981 | Thompson | 52/588.1 |
| 4,725,334 | A | * | 2/1988 | Brimm | 216/34 |
| 5,262,220 | A | * | 11/1993 | Spriggs et al. | 428/156 |
| 5,846,461 | A | * | 12/1998 | Collins et al. | 264/45.3 |

(Continued)

FOREIGN PATENT DOCUMENTS

| | | |
|---|---|---|
| CH | 284305 | 7/1952 |
| CH | 287794 | 12/1952 |

(Continued)

OTHER PUBLICATIONS

Merriam-Webster Online Dictionary—Definition of the term 'Sheet' printed Aug. 4, 2012.*

(Continued)

*Primary Examiner* — Adam Krupicka
(74) *Attorney, Agent, or Firm* — Reinhart Boerner Van Deuren P.C.

(57) ABSTRACT

A composite sheet comprising two sheets joined by material closure provides on the one hand high global and local bending stiffness, and on the other hand very good forming behavior and very high load capacity in case of great deformations, as in case of a crash for example. Both sheets of the composite sheet comprise an at least partially structured surface and a smooth surface and both sheets are at least partially joined by material closure via the structured surfaces.

15 Claims, 3 Drawing Sheets

(56) References Cited

U.S. PATENT DOCUMENTS

| | | | | |
|---|---|---|---|---|
| 5,894,045 | A | 4/1999 | Desrondiers | 428/178 |
| 6,047,876 | A * | 4/2000 | Smith | 228/111.5 |
| 6,428,905 | B1 | 8/2002 | Behr et al. | 428/594 |
| 2005/0158573 | A1 * | 7/2005 | Elzey et al. | 428/593 |
| 2006/0010807 | A1 * | 1/2006 | Whitley | 52/405.2 |

FOREIGN PATENT DOCUMENTS

| | | | |
|---|---|---|---|
| CH | 406 580 | | 1/1966 |
| CN | 1649724 | A | 8/2005 |
| DE | 877057 | | 5/1953 |
| DE | 1 912 948 | | 10/1970 |
| DE | 196 33 306 | A1 | 10/1997 |
| DE | 198 10 706 | A1 | 9/1999 |
| DE | 202004015784 | U1 | 4/2005 |
| FR | 1245009 | | 11/1960 |
| GB | 2 062 057 | | 5/1981 |
| JP | 2001358264 | A | 12/2001 |
| WO | 99/46461 | | 9/1999 |

OTHER PUBLICATIONS

Handbook of Plastics Joining, William Andrew Publishing/Plastics Design Library, 1997.*

International Search Report for International Application No. PCT/EP2007/058414, May 11, 2007.

* cited by examiner

STRUCTURED COMPOSITE SHEET

CROSS-REFERENCE TO RELATED APPLICATIONS

This application is a National Phase Application of International Application No. PCT/EP2007/058414, filed on Aug. 14, 2007, which claims the benefit of and priority to German patent application no. DE 10 2006 043 197.9-24, filed on Sep. 11, 2006. The disclosures of the above applications are incorporated herein by reference in their entirety.

FIELD OF THE INVENTION

The invention relates to a composite sheet comprising two sheets joined by material closure, a method for producing said composite sheet and the advantageous use thereof.

BACKGROUND

Composite sheets comprising two sheets joined by material closure are commonly known from the prior art. For example composite sheets designated as double layer sheets are frequently used in the construction of vehicles due to their high rigidity at relatively low weight. For example, a double layer sheet, which consists of two cover sheets, wherein at least one of the coversheets is designed as a studded plate and the studded plate is joined to the other cover sheet with its knob points by material closure, is known from European Patent EP 1 062 397 B1. The studded plate, however, is almost limited in application to flat components. In addition, sandwich sheets with a plastic core are known; their scope of application likewise being limited only to certain areas, for example the bonnet (i.e. hood), the roof or the outer door sheet of a vehicle. Both variants lack load capacity in case of great deformations, as can result in case of a crash for example. Therefore it is desirable to improve the forming behavior and the load capacity in case of high forming degrees of the prior art composite sheets, so that the scope of application of the composite sheets comprising two sheets joined by material closure can be extended.

SUMMARY OF THE INVENTION

In general, an aspect of the present invention is to provide a composite sheet having high global and local bending stiffness, and at the same time being characterized by very good forming behavior and excellent load capacity in case of high forming degrees. Another aspect of the present invention is to provide a method for producing the composite sheet as well as an advantageous use thereof.

According to a first teaching of the present invention the aspect indicated above is achieved by a composite sheet formed with two sheet, in which both sheets comprise an at least partially structured surface and a smooth surface and both sheets are at least partially joined by material closure with the structured surfaces.

In contrast to composite sheets of the prior art comprising two sheets joined by material closure, the composite sheet according to the invention exhibits a substantially higher global and local bending stiffness, particularly in relation to the weight of the composite sheet. The reason for this is that both bonded sheets are structured on one side. Sheets structured on one side have an improved bending stiffness with respect to their weight in comparison to unstructured sheets due to the structuring. For the composite sheet according to the invention, the effects of the higher bending stiffness of both sheets are cumulative. Since the exterior of the composite sheet has a smooth surface in each case, the composite sheet according to the invention additionally ensures very good forming behavior in conventional forming processes. The composite sheet is therefore particularly suitable for deep-drawing, for example. At the same time, this results in an extension of the scope of application of the composite sheet according to the invention, since a large number of products can be produced from the composite sheet according to the invention.

In a first embodiment of the composite sheet according to the invention, a simple and uniform material closure of both sheets can be achieved in that the structured surfaces of the sheets exhibit recesses and the sheets are joined by material closure at least via walls or webs arranged between the recesses. In this way a structure is produced as it is found in a similar way in a nutshell for example.

If the recesses have the form of open chambers, with the chambers preferably having a cross section becoming larger in the opening direction, the global and local bending stiffness of the composite sheet can be further improved. In particular the result of the cross section becoming larger in the opening direction of the chambers is that the connecting walls or webs are strengthened in the region of the smooth composite sheet surfaces, so that in a forming process the composite sheet behaves similarly to a single sheet and buckling of the structure can be avoided during forming.

Preferably the recesses can be formed and/or distributed regularly or irregularly, the recesses formed and distributed regularly being preferred for producing a uniform joint between both sheets. In addition recesses formed and distributed regularly simplify the production process, in which suitably structured rolls can be used for the one-side structuring of the sheets. The recesses can be stamped by means of embossing rolls for example. However other methods are also conceivable, in order to create corresponding recesses in the surface of the sheets to be structured.

A sufficiently firm joint between both sheets (i.e., a first sheet and a second sheet) can be ensured in a next embodiment of the composite sheet according to the invention, in that the walls or webs, which are arranged between the recesses, have a thickness of at least 0.3 mm, preferably a thickness of at least 0.5 mm. Advantageously, the sheets have a coating at least on the structured surface. The coating can serve as corrosion protection inside the composite sheet for example. On the other hand coating of the structured surfaces aids the composite sheet after the first and second sheets have been joined by material closure.

In a next further embodiment of the composite sheet according to the invention a filling material, which at least partially fills out the recesses of the joined sheets, is additionally provided. The filling material can improve the behavior of the composite sheet in particular with regard to a compression of the composite sheet due to bending load.

Preferably for this purpose the filling material consists of a plastic matrix with embedded particles, the particles exhibiting a higher modulus of elasticity than the plastic matrix. As a result of the filling material mentioned the bending behavior of the composite sheet can be influenced in a targeted way. In addition, however, damping properties can be adjusted if filling materials with corresponding damping properties are used.

If the material closure of the composite sheet is achieved by adhering, the forming behavior of the composite sheet is improved in that a connecting layer ensuring the material closure between both sheets can be hardened and/or cross-linked at least in two steps. For example, as a result of this, only partial hardening and/or cross-linking of the material closure can be initially achieved before forming the composite sheet. Thus it is possible that stresses within the composite sheet can be eliminated during the forming operation and the final strength of the joint between both sheets can be obtained at the same time with subsequent hardening or cross-linking of the connecting layer. Accordingly the connecting layer can be hardened or cross-linked in a pass through a varnishing oven following the forming operation.

Particularly high bending stiffness can also be achieved by the sheets being soldered or welded together. Soldered joints and welded joints usually show maximum mechanical strength and therefore positively affect the increase of the bending stiffness of the composite sheet according to the invention. In addition, if a soldering foil is used for example, the closeness of the gap between both sheets can be increased. The soldered joint can then also serve as corrosion protection at the same time.

To guarantee the necessary strength of the composite sheet, when used in the construction of vehicles for example, the sheets preferably consist of steel or of a steel alloy. The use of other metallic or organic materials is in principle also conceivable.

In order to limit the weight of the composite sheet according to the invention, the sheets exhibit a thickness of at most 2 mm, in particular at most 1 mm, preferably at most 0.8 mm. With these thicknesses it is ensured that the composite sheet produced, apart from high strength or good bending stiffness, respectively, has substantially reduced weight in comparison to solid sheets.

Finally, the composite sheet according to the invention can be further advantageously embodied in that the sheets consist of different materials and/or material thicknesses so that it is possible to adapt the composite sheet according to the load.

According to a second teaching of the present invention as regards the method the aspect described above is solved in that a method for producing a composite sheet comprising two sheets joined by material closure comprises the following steps:

providing a first and a second sheet, one-side structuring of the first and the second sheet by incorporating recesses on one side, and at least partially joining of the first and second sheets via the structured surfaces by material closure.

As already stated above, a composite sheet having high global and local bending stiffness and at the same time having good forming behavior and best load capacity in case of great deformations can be provided in a simple manner by the method according to the invention. In particular the method according to the invention can be carried out particularly economically by the first and the second sheet in each case being provided from a strip wound on a coil, structured on one side by skin pass rolls and afterwards the structured surfaces of the strips being joined together in order to produce a strip consisting of the composite sheet according to the invention. The strip consisting of the composite sheet according to the invention can then be cut into sheets in the required dimensions.

Preferably the structured surfaces of the sheets are adhered, welded or soldered together. Depending on the joining method the sheets must be treated before joining. For example, before the structured surfaces of the sheets are adhered to one another they must be coated with and adhesive. However, other pre-treatment methods are also conceivable, for example application of a primer for the adhesive layer.

Preferably in the case of adhering or soldering, an adhesive foil or soldering foil is laid between the structured surfaces of the sheets, so that the joint of the structured surfaces is established in a subsequent process step. In the case of soldering this can take place by inductive heating of the sheets for example. An adhesive foil can be hardened and/or cross-linked likewise by heating.

The sheets are preferably welded by resistance welding, the weld joint being produced by means of a current flowing between the first and the second sheet. Due to the small surface area in the region of the joint between the two sheets the joint regions are heated to high temperature so that the sheets are welded together. For example, a particularly uniform distribution of the weld joint can be obtained by sinusoidal waveform embossing, running cross-wise to the strip, on one side of both sheets.

Finally, the aspect indicated above is solved according to a third teaching of the present invention by using the composite sheet according to the invention, in particular produced according to the method according to the invention, for producing structural components, especially outer skin components of a vehicle.

The composite sheet according to the invention, as already described above, not only exhibits an increased bending stiffness, but can still be formed very well and exhibits a high load capacity in case of great deformations. In using the method according to the invention for producing the composite sheet, this can in addition be provided economically, so that use in the construction of vehicles is advantageous.

BRIEF DESCRIPTION OF THE DRAWINGS

There are a plurality of possible embodiments of the composite sheet according to the invention as well as the method according to the invention for producing the composite sheet and the use thereof. For this purpose on the one hand reference is made to the claims, and on the other hand to the description of several exemplary embodiments in conjunction with the drawing, wherein:

DETAILED DESCRIPTION

Figure 1:
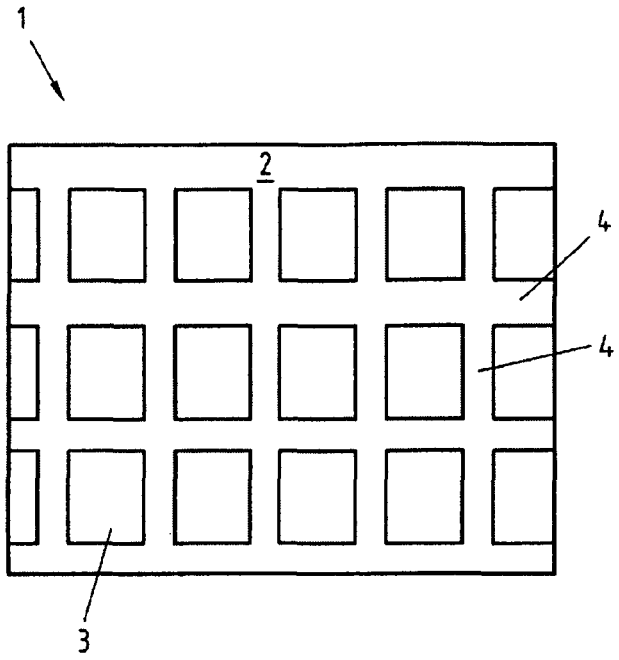
FIG. 1 is a top view onto a one-side structured sheet of an exemplary embodiment of a composite sheet according to the invention.

Firstly, FIG. 1 shows a sheet 1 of an exemplary embodiment of a composite sheet according to the invention in top view. The sheet 1 is structured on one side, namely by stamping of recesses 3, so that webs or walls 4 remain between the recesses 3. The sheet 1 exhibits a regular arrangement of the recesses 3 for example and in this respect also regular formation of the webs or walls 4, respectively. In addition the recesses 3 exhibit a rectangular cross section and are therefore formed regularly. However, it is also conceivable that the recesses 3 are formed and distributed irregularly over the sheet surface 2. The webs 4, which are arranged between the recesses 3, exhibit a thickness of at least 0.3 mm in the present exemplary embodiment, preferably a thickness of at least 0.5 mm. By means of the thickness of the webs 4, it is ensured that the composite sheet has particularly high resistance to compression. This is especially advantageous in case of buckling or pressure stress. However, it is also quite conceivable to use a smaller thickness for the webs or walls between the recesses. In this case the forming processes must be adapted accordingly.

Figure 2:
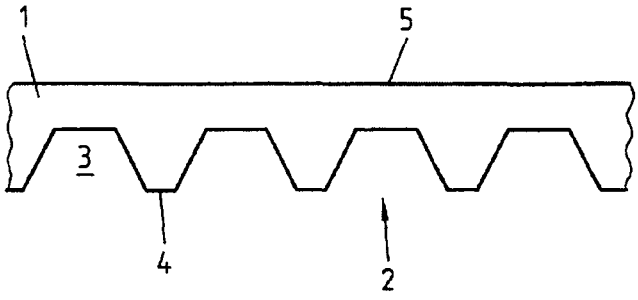
FIG. 2 is a sectional view of the one-side structured sheet from FIG. 1.

In the sectional view of the one side structured sheet 1 of an exemplary embodiment of a composite sheet according to the invention illustrated in FIG. 2, it is clear that on the one hand the recesses 3 have a cross section becoming larger in the opening direction of the recesses, and on the other hand the surface 5 lying opposite to the structured surface 2 of the sheet 1 is smooth. Strengthening of the webs 4 towards the surface 5, stressed during forming for example, is achieved due to the cross sections of the recesses 3 becoming larger in the opening direction, so that these counteract buckling of the surface.

Figure 3:
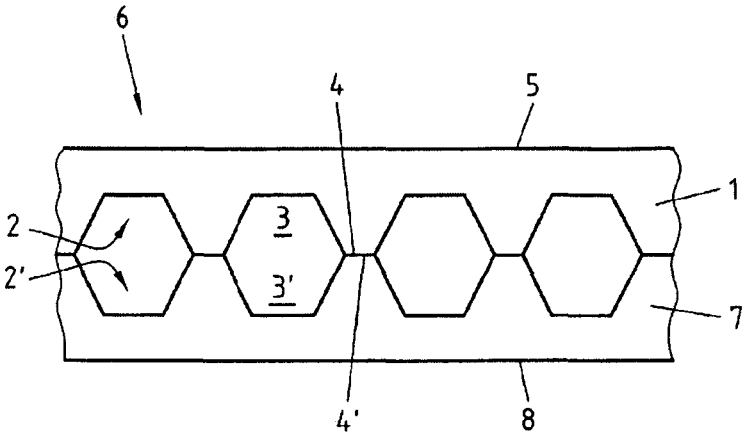
FIG. 3 is a sectional view of the first exemplary embodiment of the composite sheet according to the invention.

FIG. 3 shows an exemplary embodiment of the composite sheet 6 according to the invention in a schematic sectional view. Two one-side structured sheets 1, 7 are joined via their structured surface 2 by material closure. Both sheets 1, 7 are joined via the webs 4, 4', which are arranged between the recesses 3, 3'. The joining method used here can be adhering, soldering or welding.

If the connection between the sheets 1, 7 consists of a soldered joint or a welded joint, the composite sheet according to the invention can exhibit very high bending stiffness as well as maximum mechanical strength in case of a load due to a crash. In order to avoid corrosion inside the composite sheet 6 according to the invention, usually a coating—not illustrated in the figure—is provided at least on the structured side of the sheets. This coating can also be applied to the outside surfaces 5 and 8. As can be recognized from FIG. 3 the composite sheet 6 according to the invention exhibits a smooth surface 5, 8 on both sides, with the result that the composite sheet according to the invention can be used without problems in conventional forming processes.

Figure 4:
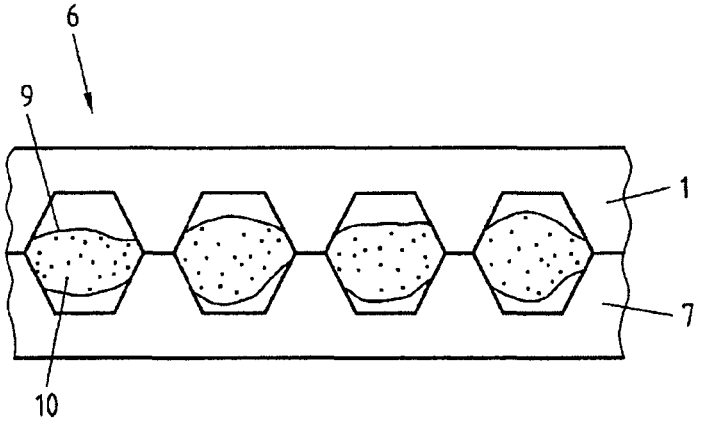
FIGS. 4 and 5 are a sectional view of a second and a third exemplary embodiment of the composite sheet according to the invention and FIG. 6 is a schematic view of an exemplary embodiment of a method according to the invention for producing the composite sheet.

FIG. 4 shows a second exemplary embodiment of the composite sheet 6 according to the invention likewise in a schematic sectional view. In contrast to the exemplary embodiment from FIG. 3 a filling material, which preferably consists of a plastic matrix 9 with particles 10 embedded therein, is arranged in the cavities of the composite sheet. As a result of the plastic matrix 9 and the particles 10 embedded therein, the bending behavior of the composite sheet 6 according to the invention can be improved, since the plastic matrix can absorb forces arising in the interior. If the bending stress is permanent, however, it is advantageous to dispense with a plastic matrix and make the joint between the two sheets using a soldered joint or a welded joint. As a result of this, particularly if the bending stress alternates, the danger of the plastic matrix 9 creeping can be prevented. However, the damping properties of the composite sheet can also be adjusted by means of the filling material.

Figure 5:
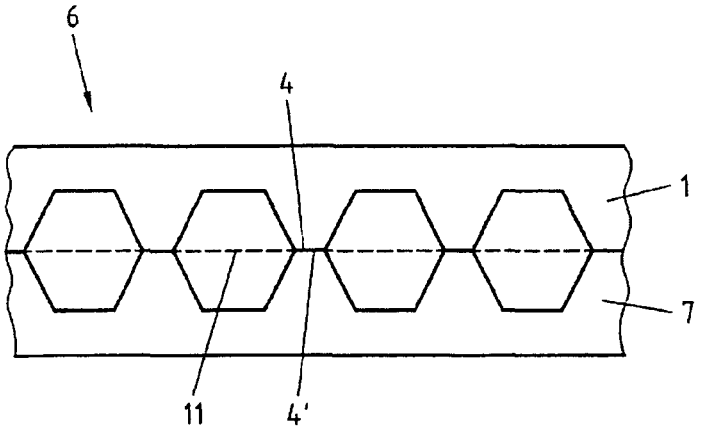

FIG. 5 shows a third exemplary embodiment of the composite sheet 6 according to the invention likewise in a schematic sectional view. An adhesive foil or a soldering foil 11 is arranged between both sheets 1, 7, which ensures the joint of both sheets 1, 7 during production. If a soldering foil 11 is provided, the soldering foil 11 can be melted by heating for example, preferably by inductive heating, of the sheets 1, 7, so that a soldered joint is produced in the region of the webs 4, 4'. If an adhesive joint is to be made between both sheets 1, 7, the adhesive foil 11 can be preferably constituted so that this can be hardened and/or cross-linked in at least two steps. Thus, firstly the joint can be maintained in such a way that the two sheets can also be formed in the region of the webs 4, 4' in a forming process, without stresses being created within the composite sheet. The strength of the joint between both sheets is then actually obtained as a result of subsequent hardening or, respectively, cross-linking of the joint between the sheet 1 and sheet 7. Afterwards the composite sheet 6 exhibits the required high local and global bending stiffness.

Figure 6:
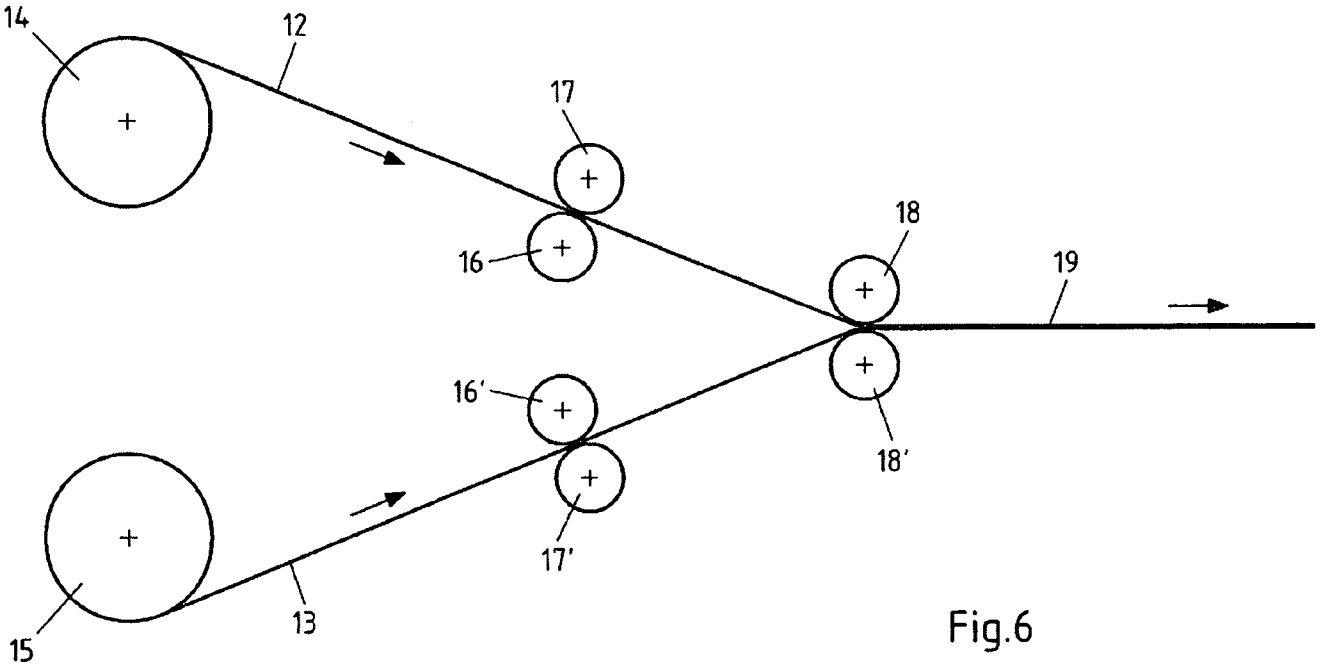

FIG. 6 shows a schematic illustration of an exemplary embodiment of the production method according to the invention for a composite sheet. Firstly, two strips 12 and 13 are unwound from a coil 14 or 15, respectively. Both strips pass through pairs of skin pass rolls 16, 17, wherein only the skin pass rolls 16 and 16' exhibit a structured surface. The rolls 17 and 17' only serve as a counter support and do not, or only slightly, influence the structure on the sides of the strips 12, 13, facing towards the roll. The now structured strips 12, 13 run into a further pair of rolls 18, 18'. At this point various joining methods can now be used. For example it is conceivable to insert a—not illustrated—adhesive foil or soldering foil into the gap between the pair of rolls 18, 18' and to heat the strips 12, 13 including the foil in the region of the pair of rolls. On the other hand by means of resistance welding it is possible to conduct a current between both rolls 18 and 18', so that welding takes place in the region of the webs 4 and 4' in the region of the contact points of the strips 12, 13. A strip-type composite sheet 19, which is characterized by outer smooth surfaces and exhibits with low weight a substantially higher local and global bending stiffness in comparison to a conventional sheet of similar thickness, is subsequently available. The thicknesses of the strips 12, 13 as well as of the sheets 1 and 7, which were described in the above figures, usually are up to 2 mm at the most. Normally, the typical thicknesses of the individual sheets are approximately 0.5 mm, so that a composite sheet with a total thickness of approximately 1 mm is formed. This has the advantage that forming can take place without problems but with conventional means due to the increased bending stiffness of the composite sheet, that the composite sheet exhibits very good load capacity behavior in case of great deformations and that its weight is low at a high mechanical strength in comparison to conventional composite sheets. Corresponding composite sheets 6, 19 can therefore be used particularly well in the construction of vehicles, especially as structural or outer skin components.

The invention claimed is:

1. Composite sheet comprising two single layer sheets joined by material closure, wherein each of the two single layer sheets comprise an at least partially structured surface and a smooth surface, and each of the two single layer sheets are at least partially joined by material closure via the structured surfaces, such that projections of the structured surfaces of each of the two single layer sheets generate opposite surfaces at which both single layer sheets are joined in direct contact wherein the two single layer sheets consist of steel or a steel alloy, wherein the recesses have the form of open chambers, and wherein the chambers have a cross-section becoming larger in the opening direction.

2. Composite sheet according to claim 1, wherein the structured surfaces of the two sheets exhibit recesses and the two sheets are joined by material closure at least via walls or webs arranged between the recesses.

3. Composite sheet according to claim 2, wherein a filling material which at least partially fills out the chambers of the joined sheets, is provided.

4. Composite sheet according to claim 3, wherein the filling material consists of a plastic matrix with embedded particles, wherein the particles exhibit a higher modulus of elasticity than the plastic matrix.

5. Composite sheet according to claim 2, wherein the recesses are formed and/or distributed irregularly or regularly.

6. Composite sheet according to claim 2, wherein the walls or webs, arranged between the recesses, have a thickness of at least 0.3 mm.

7. Composite sheet according to claim 1, wherein each of the two sheets has a coating at least on the structured surface.

8. Composite sheet according to claim 1, wherein a connecting layer ensuring the material closure between both sheets can be hardened and/or cross-linked at least in two steps.

9. Composite sheet according to claim 1, wherein the two sheets are soldered or welded together.

10. Composite sheet according to claim 1, wherein each of the two sheets exhibit a thickness of at most 2 mm.

11. Composite sheet according to claim 1, wherein the two sheets consist of different materials and/or material thicknesses.

12. Method for producing a composite sheet comprising two single layer sheets joined by material closure the method comprising the following steps: providing a first and a second single layer sheet wherein the two single layer sheets consist of steel or a steel alloy, one-side structuring of the first and the second single layer sheets by incorporating recesses on one side, thereby leaving the other side of each of the first and second single layer sheets as a smooth surface, wherein the recesses have the form of open chambers, and wherein the chambers have a cross section becoming larger in the opening direction, and at least partially joining of the first and second single layer sheets via the structured surfaces by material closure, such that projections of the structured surfaces of each of the two single layer sheets generate opposite surfaces at which both single layer sheets are joined in direct contact.

13. Method according to claim 12, wherein the structured surfaces of the first and second sheets are adhered, welded or soldered together.

14. Method according to claim 13, wherein an adhesive foil or a soldering foil is laid between the structured surfaces of the first and second sheets before adhering or soldering, respectively.

15. Method according to claim 12, wherein the first and second sheets are at least partially joined by resistance welding.

* * * * *